United States Patent [19]

Emmerich

[11] 4,165,790

[45] Aug. 28, 1979

[54] ROOF DRILL BIT

[75] Inventor: Kenneth C. Emmerich, Lexington, Ky.

[73] Assignee: Fansteel Inc., North Chicago, Ill.

[21] Appl. No.: 910,616

[22] Filed: May 30, 1978

Related U.S. Application Data

[63] Continuation of Ser. No. 749,457, Dec. 10, 1976, abandoned.

[51] Int. Cl.[2] ..... E21B 9/02; E21C 1/14

[52] U.S. Cl. ..... 175/410; 175/411

[58] Field of Search ..... 175/410, 411, 415, 418, 175/417, 320, 207, 213

[56] References Cited

U.S. PATENT DOCUMENTS

| | | | |
|---|---|---|---|
| 2,756,967 | 7/1956 | Meutsch | 175/415 X |
| 3,106,972 | 10/1963 | Thornsberry | 175/410 |
| 3,163,246 | 12/1964 | Vagins et al. | 175/415 |
| 3,187,825 | 6/1965 | Bower, Jr. | 175/418 X |
| 3,434,554 | 3/1969 | Bower, Jr. | 175/418 X |
| 3,867,515 | 4/1974 | Evans | 175/410 |

FOREIGN PATENT DOCUMENTS

| | | | |
|---|---|---|---|
| 623481 | 7/1961 | Canada | 175/410 |
| 454064 | 6/1968 | Switzerland | 415/418 |
| 668991 | 3/1952 | United Kingdom | 175/410 |

*Primary Examiner*—William Pate, III

*Attorney, Agent, or Firm*—Barnes, Kisselle, Raisch & Choate

[57] ABSTRACT

An improved drill bit for the mining field for use as a roof drill, tunnel drill, rock boring and highway construction, both as a rotary and a rotary percussion drill, which includes a drill head with a diametrical slot positioning a brazed cutting blade, the head having a male drive shank to interfit with a female driver tube and having axial passages leading to chip slash pockets for removal of chips either by incoming pressure fluid or outgoing suctioning action. The supporting prongs of the drill head on opposite sides and at opposite ends of the blade are narrowed in thickness to provide chip clearance and designed to overlap centrally to provide tip strength and central support for the blade.

2 Claims, 20 Drawing Figures

ROOF DRILL BIT

Figure 1:
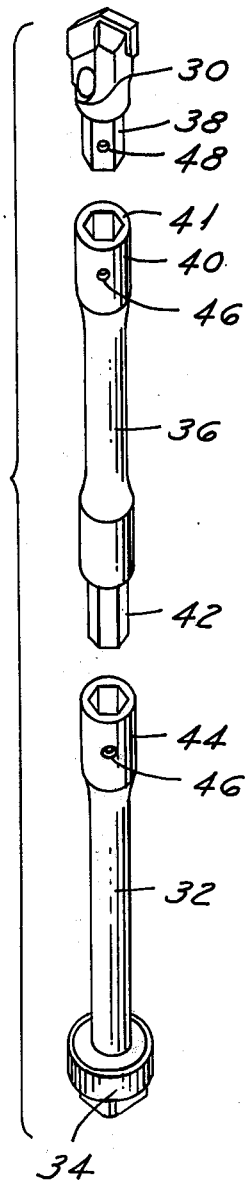

This is a continuation of application Ser. No. 749,457, filed Dec. 10, 1976, entitled "Roof Drill Bit" now abandoned.

This invention relates to a Roof Drill Bit and more specifically to a drill bit designed particularly for drilling coal, rock, concrete, mineral ore and other hard substances.

The nearest state-of-the-art drill bit design to that of the improved drill bit of this invention is believed to be that which includes a tubular head having an out-of-round (hexagonal) recess in one end to receive a male hexagonal driver and having a diametrical slot at the other end into which a flat, pointed cutting insert, such as tungsten carbide is secured. Quarter segments of the tube at the cutting end are removed to provide axial openings to the center passage of the tube for fluid flow in connection with the removal of chips, particles and dust. This device has an annular groove inside the driver recess which is intended to cooperate with a retainer device on a driver insert.

This drill bit above described has disadvantages in that the male driver insert must have a fluid recess and thus has a wall thickness which is weak and subject to breakage. Also chips and dust have a tendency to pile up at the juncture of the bit and the driver rod. This causes pile up in the hole being drilled which causes a binding of the drill bit with resultant increased strain on the drive juncture.

The present invention contemplates an improved drill bit design which can be used for roof drilling in mining areas where the roof areas are to be reinforced by anchor bolting systems, i.e., a system wherein a mechanical expansion and tensioning bolt is inserted in a drilled hole, or by resin bolting wherein a drilled hole is charged with a setting resin and activated by a core bolt which is inserted to mix the resin and provide a core for the resin which sets around it (Mining and Metallurgy, Bulletin No. 776, July 1971). The bit may also be used in drilling charge holes for blasting, for rock boring, highway construction, light post base anchor holes, anchorage railings and the like.

The holes used in mining applications are sometimes quite deep and a drill driver may have several sections of drive shafts linked together before the hole is complete. It has been customary to utilize a starter, a driver, a middle extension, and a finish extension. With the present drill bit construction, the starter and the finish extension can be eliminated, and all that is needed is a driver and such middle extensions as are required for the desired depth of the hole.

By utilizing a bit with a male driver extension cooperating with a female driver element, a stronger bit unit can be formed with the chip and dust openings in the bit itself, thus eliminating the need for side openings in the driver. By reason of this construction, numerous additional advantageous features can be incorporated into the bit. The internal passage on the bit shank can serve as a venturi to increase the flow of fluid. Side and back clearance can be provided in the bit to prevent the build-up of dust and chips which will cause resistive binding and chugging in the drilling operation.

The bit design also lends itself to the use of a chevron shaped insert which is self-centering, assuring maximum concentricity, increased brazing area, and more web strength at the center tip section. An additional feature of the male shank bit design is the adaptability to a variety of retaining devices which are positive in action to avoid the hang-up of the bit in a hole when the driver elements are retracted.

It will be appreciated that in the type of drilling under consideration in rock, coal and other minerals, there are two systems for removing chips and dust. One is the suction system wherein a vacuum pump is connected up to the driving shafts and ultimately to the bit so that the removed material is sucked through the bit and the driving shafts into a proper receptacle. With this system, the holes in the bit are usually larger than the other system which utilizes water under pressure. This water is passed through the drive shafts and the bit and, in flowing outwardly around the bit and the shafts, it carries away the chips and cuttings. A different external configuration is utilized on the suction bit as contrasted with the water pressure bit as will be seen in the following description.

These and other features of the drill bit will be evident in the following specification and claims in which the invention is described together with the principles of operation and a detailed presentation of the best mode presently contemplated for the practice of the invention directed to persons skilled in this art to enable them to utilize the invention.

DRAWINGS accompany the disclosure and the various views thereof may be briefly described as:

FIG. 1, a general view of a bit and the driver mechanism.

Figure 2:
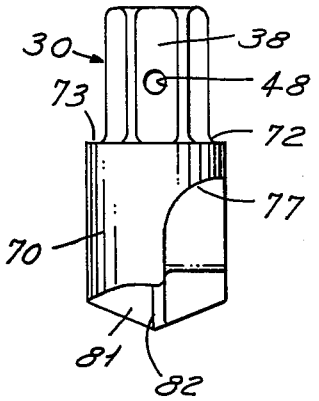

FIG. 2, a side view of a bit blank prior to machining.

Figure 3:
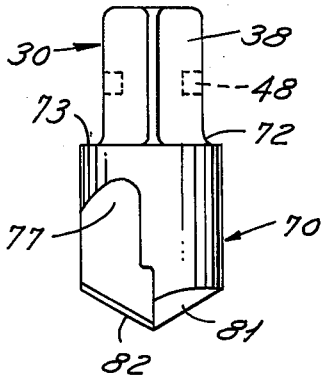

FIG. 3, a side view of the bit blank 90° turned from the view of FIG. 3.

Figure 4:
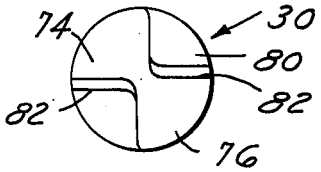

FIG. 4, an end view of the bit blank.

Figure 5:
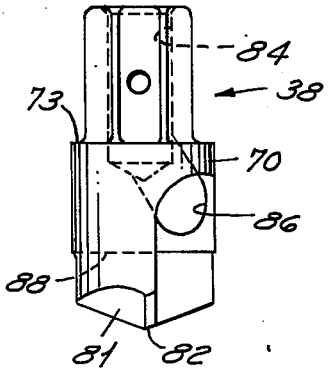

FIG. 5, a side view of a drilled and machined blank for use in a suction system.

Figure 6:
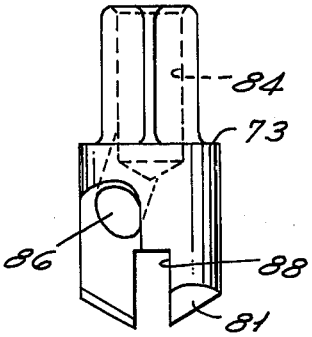

FIG. 6, a side view of a drilled and machined blank 90° turned from the view of FIG. 6.

Figure 7:
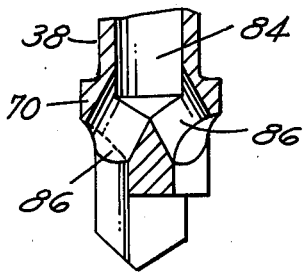

FIG. 7, a sectional view of the drilled and machined blank.

Figure 8:
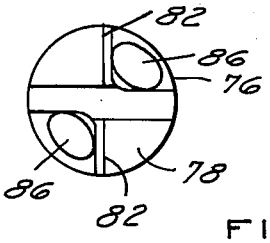

FIG. 8, an end view of the machined blank.

Figure 9:
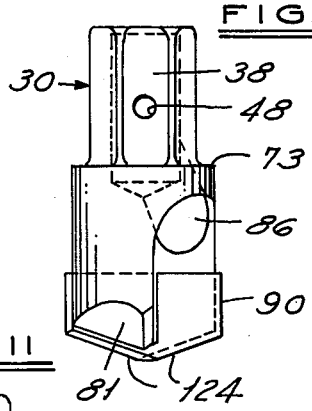

FIG. 9, an assembly view of a finished bit.

Figure 10:
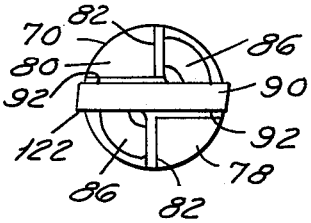

FIG. 10, an end view of the bit assembly.

Figure 11:
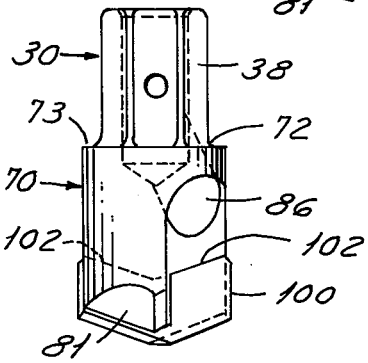

FIG. 11, an assembly view of a bit with a modified cutter insert.

Figure 12:
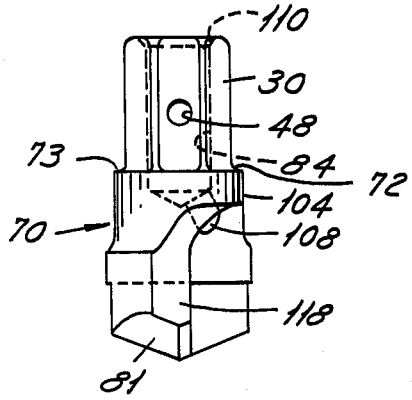

FIG. 12, a side view of a bit blank modified for pressure flow chip removal.

Figure 13:
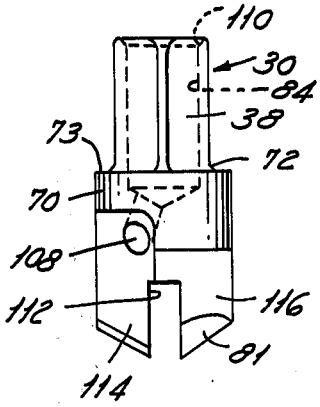

FIG. 13, a side view 90° turned from the view of FIG. 12.

Figure 14:
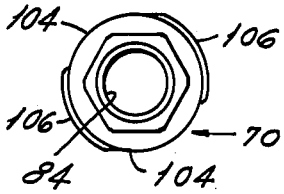

FIG. 14, a shank end view of the blank of FIGS. 12 and 13.

Figure 15:
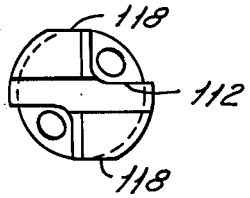

FIG. 15, an end view of the drill bit from the cutting end.

Figure 16:
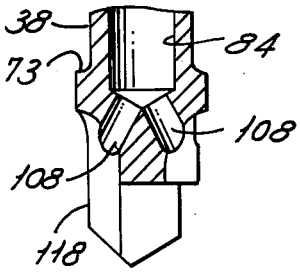

FIG. 16, a sectional view of the pressure flow bit.

Figure 17:
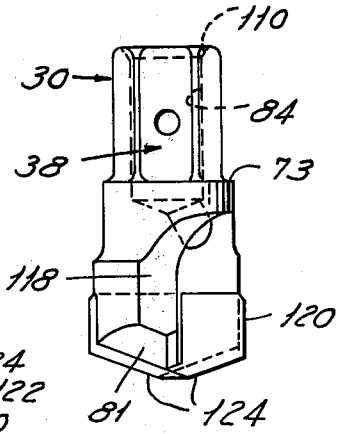

FIG. 17, an assembly view of the pressure flow bit.

Figure 18:
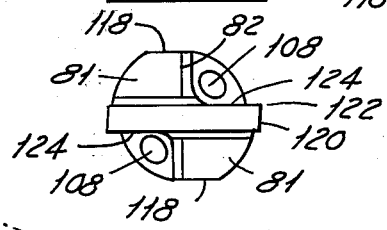

FIG. 18, an end assembly view of the pressure flow bit.

Figure 19:
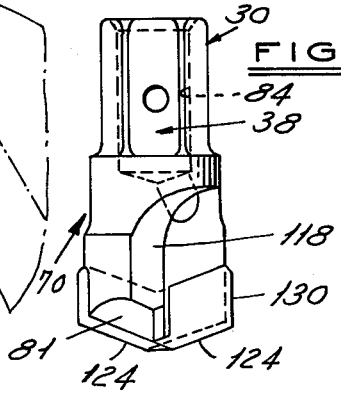

FIG. 19, a side view of a pressure flow bit with a modified chevron type insert.

Figure 20:
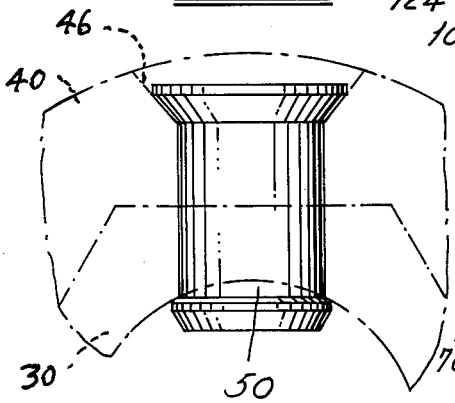

FIG. 20, a view of a retainer device.

WITH REFERENCE TO THE DRAWINGS, in FIG. 1, there is illustrated, in a perspective view, a drilling system which includes a drill bit 30, a driver shaft or tube 32 having a drive coupling 34, and an intermediate or middle extension shaft 36. The bit has a male drive shank 38, hexagonal in cross-section, which interfits with a female socket end 40 on one end of middle extension 36. The other end of extension 36 has a male shank 42 similar to that on the bit which will interfit with a female socket end 44 on driver 32. It will be noted that there is a hole 46 in socket 40 which will register with a hole 48 in bit shank 38. A retainer plug 50, as illustrated in FIG. 20, formed of a material such as Teflon, to resist heat, can be driven into the registering holes 46, 48 to lock the bit to the extension. This plug 50 can be readily driven from its working location by a drift pin when the bit is to be removed. A similar retention system can be utilized between driver 32 and extension 36 if desired. Other retainers such as roll pins and blind rivets may also be utilized.

We turn now to the details of the drill bit. A bit blank is shown in FIGS. 2 and 3 having an enlarged head portion 70 on the shank portion 38. This blank is preferably a steel forging although it may also be an investment casting or even formed by powder metallurgy methods. The shank 38 has a hexagonal cross-section and there is a radius 72 formed at the juncture of the shank with the shoulder 73 of the head having a minimum radius of 1/16" but preferably in a range of 3/32"±1/64". As illustrated in FIGS. 2, 3 and 4, there are segmental cavities 74, 76 formed axially inward from the outer end of the head 70 terminating in a curved sweep 77 to the outside of the head leaving head stock in the form of prongs 78, 80 which extend diametrically over the center line to form crests 82 angled away from the tip center.

In FIGS. 5 to 8, the blank 38 in the form of the original forging is shown after it has been machined and drilled for use in a suction system of drilling. This machining involved providing the axial opening 84 in the shank 38 which projects up to the head portion 70, and hole 86 are drilled from the bottom of the segmental cavities 74 and 76 into the axial recess 84. These holes 86 are about as large as they can be while leading a reasonable amount of stock on the outside of the drill body. All junctions of internal holes in the body of the bit, of this embodiment and that shown in FIGS. 12 to 19, should have smooth radii to achieve maximum strength in the part and the best flow for cuttings in the case of suction type drills and for water when that is used as the fluid. Such smooth radii help to avoid build-up of cuttings in the tool and hence reduce any tendency for it to plug during operation. To complete the machining, there is a slot 88 milled diametrically across the cutting end of the body 70 to receive a cutting blade 90 as illustrated in FIGS. 9 and 10.

The insert 90 is preferably silver brazed into the slot, the silver brazing alloy lying along the juncture line 92 where the opposite ends and sides of the insert 90 are flat against the spaced prongs 78 and 80 formed when the slot for the insert is cut through the body 70.

It will be noted that the body 70 retains its full round circumference in this embodiment which is directed to the suction system. It will be noted also that the prongs 78 and 80 overlap each other in spaced relation at the center of the tool, as shown in FIGS. 8 and 10, so that there is a maximum amount of the prong surfaces in contact with the blade insert, and also a strengthening of the center of the unit by reason of this overlap and the mass of metal at the tool tip.

The insert support prongs are provided with a flat secondary clearance angle surface 81 disposed at about 30° in order to allow easier passage of cuttings and less impediment of water flow up and out of the insert to fully cover the insert and allow easy return flow downward along the tool and drive shaft.

The crests 82 of the prongs are also illustrated in FIGS. 8 and 10 wherein the prong reaches a crest at 82 and starts tapering toward the recesses 74 and 76 now containing the holes 86.

This structure results from the overlap of the prongs. The amount of overlap depends on the tool size and can be increased proportionately as the tool diameter increases. This feature increases the mechanical support for the carbide insert, thus improving the resistance to chipping and breaking. This also increases the brazed area on the sides of the insert which substantially increases the strength of the brazed bond. The transverse insert seat of the insert prongs should have a width approximately the same as the thickness or width of the carbide insert plus the brazing alloy. This provides maximum strength in the brazed bond, maximum support to the insert, and minimum impediment to upward or downward flow of the water or cuttings. The flow passageways on either side of the support prongs are shown parallel to the axis of the tool to provide maximum flow clearance, but these passageways might be angled with respect to the tool axis should there by a reason to direct the flow in a different direction for some application. Thus, the assembled unit with the blade insert brazed in place shown in FIGS. 9 and 10 is ready for use by inserting the male shank 38 into the female recess in the socket 44 of shaft 32 to start a hole. Subsequently, if the hole is deep enough, the middle extension 36 can be placed between the shaft 32 and the bit 30. The suction source will be connected, of course, to the coupling 34 as well as the drive mechanism to obtain the rotary motion.

In FIG. 11, a modified unit is shown in all respects similar to the previously described embodiment with the exception that the cutting bit insert blade illustrated at 100 has a chevron shape with a base angle that approximates the outer angle. The slot then that is cut in the body 70 will also have this type of base so that the insert 100 will be self-centering during the brazing operation and also have an increased resistance to side thrust by reason of the angled base portions 102. This embodiment provides somewhat greater contact surface for the brazing and thus a stronger joint and it facilitates the brazing operation as well as the effectiveness of the unit in operation since it will be centered and prevent out-of-round holes or greater pressure on one side than the other due to a variation in side clearance.

This chevron design allows more regrinds and a truer, more concentric tool. There is, at the same time, a reduction in the amount of carbide needed for the insert, yet the life of the tool is not reduced since the carbide is reduced in the center area where there is no wear. Thus, the design provides increased tool life, reduces wobble during drilling resulting in uniform wear characteristics in the tool instead of wear predominantly on one side as can occur if the base of the insert is flat and the position during brazing adjusted visually and manually as is most often the case. Not only does this design improve the life of the bit, but the steel drill rods used to drive the bit will have an improved life because of reduced fatigue stresses resulting from a wobble action.

In FIGS. 12 to 19, a modified cutting insert is shown designed especially for the pressure fluid system of operation which usually includes the directing of water through the interior of the drive shafts and the bit to force chips and particles back along the sides of the hole being drilled. In each case, the function of the operating fluid is to cool the cutting bit and reduce dusting as well as to remove the debris. Reduction in the dust in a drilling operation provides improved working conditions in the drilling area and also reduces the possibility of fire or explosion. The same blanks that are illustrated in FIGS. 2 to 4 are utilized to create the second embodiment although different forgings which might reduce the necessary machining could be used.

As shown in FIG. 12, the machining has been accomplished to provide the hexagonal shank 38 with the axial opening 84 and the body of the unit has been reduced in diameter at 104 on opposite sides of the body to leave the cylindrical and circular lands 106 as contact and guide surfaces while creating side passages for the flow of coolant fluid. The segmental pockets in the bit are drilled at the base to provide the holes 108 connected to the interior passage 84.

It will be noted that the holes 108 are smaller in diameter than those utilized in the embodiment of FIGS. 2 to 10, leaving more body stock. It will be noted also that the axial passage 84 has a bell mouth flare 110 which is also found in FIGS. 2 to 11 for the purpose of creating venturi effect as the fluid enters the passage 84. This is most significant in the water system presently being described. The provision of a slot 112 for receiving the cutting insert creates the two prongs 114 and 116 at the cutting end of the bit. These prongs are preferably flattened on the respective sides at 118 to provide additional fluid passages for the outflowing water and enabling a flushing of the particles back along the sides of the hole. This flattening and removal of stock is shown most clearly in FIGS. 15 through 19. The working ends of the prongs are also formed or machined to have a 30° secondary clearance angle as shown at 81, as previously described in connection with the embodiment of FIGS. 2 to 11, to improve the flow characteristics of the moving fluid used, in this case, water.

In FIGS. 17 and 18, the machined bit is shown with the blade insert 120 brazed in place. In each case, the cutting insert has a leading cutting edge 122 with a relieved portion behind it to create the necessary cutting action on the sides of the device. A similar configuration is provided on the cutting edges which face the bottom of a hole being drilled as shown at 124.

In the operation of the water system bit as illustrates in FIGS. 12 to 18, the water is directed through the drill shafts 32 and 36 into the axial passage 84 of the drill shank 38 past the ensmalling radius 110 which creates a venturi effect to increase the velocity of the fluid as it passes out of the openings 108 to the cutting edges of the bit and thence rebounds from the bottom of the hole being drilled to pass outwardly of the hole around the clearance areas of the bit and the driving shafts.

In FIG. 19, a bit substantially as shown in FIGS. 12 to 18, is provided with a chevron type cutting insert 130. This structure would have the same advantages as described in connection with the embodiment shown in FIG. 11.

In FIG. 20, a retainer plug is shown which could be utilized in connection with the holes 46 in the drive shafts 32 or 36 and the hole 48 in the shank 38 which would be in registration in assembly. It will be appreciated that the mouth of the recesses in the socket ends 40 and 44 of shafts 32 and 36 would be flared to receive the fillet 72 joining the shanks 38 with the body 70. The retainer plug 50 illustrated in FIG. 20 is one example of a plug formed with Teflon which can be driven in to the registering holes to lock the parts together. As previously indicated, other types of retainers, such as roll pins and spring clips, could also be used. In addition to the plug-snap retainer such as the Teflon or any other suitable non-flammable plastic, a deformable metal may be used such as copper or aluminum which is soft enough to drive into and through holes in the steel drill rod and the shank of the bit. These retainers may be installed and removed with the use of a punch or by hand.

The change of dimension from the shank 38 to the head 70, in addition to permitting a drive shaft with a female socket, provides a stronger drill bit shank with a venturi central passage especially effective in the pressure system. However, another advantage derives from this configuration in that a shoulder 73 is formed on the head 70 outside the radius 72. This shoulder cooperates with the end 41 of socket 40 so that a thrust surface is developed which assists in the application of the drilling feed forces. In cases where the bit is used for rotary percussion drilling, this is especially important.

It will be appreciated that the male shank 38 can be hexagonal, as shown, in cross-section, rectangular, square, oval, or any other out-of-round configuration which allows the features of the present bit construction to be retained. The preferred embodiment is hexagonal with square as a second preference.

The shank and body of the tool bit are preferably formed of forged steel, but any metal may be used which will have the necessary shock resistance and strength for the rugged conditions to be met in the mining field. The cutting insert is preferably formed of a cemented tungsten carbide having a quality which adapts it to rock boring or coal mining. There are many types and grades of carbide which may be selected for particular applications and other comparable cutting metals or powdered metallurgical combinations can be utilized. The cutting inserts are shown with a sharp corner on the outer facing surfaces, but a land may be provided if rotary percussion type drilling is to be done.

While the inserts have been shown as brazed into the provided slots, mechanical means might be used to hold them in the head. However, the brazed inserts are preferred since this provides a reinforcement to the entire structure and also enhances the heat conduction from insert to shank to prevent undue build-up in the insert itself.

I claim:

1. In a drill bit for rotary and percussion drilling of hard materials such as rock, coal, concrete and the like and of the type utilizing a drill body with a driving shank at one end and a cutting bit secured transversely of the body at the other end, that improvement which comprises:

(a) a central body portion having a shank end and a cutting end, said shank end being circular in cross-section and having a first diametrical dimension, said cutting end having a second diametrical dimension in diametrically opposed enlarged quadrants larger than said first dimension, said ends joining at an annular shoulder, said cutting end having opposed flat portions tangential with circular opposed quadrants with a diameter substantially that of the first dimension, (b) a driving shank axially disposed on said body at the shank end and having a central coolant passage extending into said body, (c) support prongs extending from the cutting end of said body in said enlarged quadrants located substantially on opposite sides of perpendicular diameters of said central body but each extending past a common diameter to overlap, said central coolant passage terminating in coolant outlets on the shank end side of said shoulder open respectively to the other quadrants between said prongs, (d) said prongs being recessed at each digital end along one diameter of said body portion to receive a transverse cutting bit having axial cutting edges on opposite sides of the ends thereof away from the supporting prongs and axially in line with said coolant outlets.

2. A drill bit as defined in claim 1 in which the said overlapping support prongs crest at the diameter perpendicular to the cutting insert and taper downwardly to each side of said crest to provide a smooth cross flow of coolant from said coolant outlets to the support prongs.

* * * * *

UNITED STATES PATENT AND TRADEMARK OFFICE

CERTIFICATE OF CORRECTION

PATENT NO. : 4,165,790

DATED : August 28, 1979

INVENTOR(S) : Kenneth C. Emmerich

It is certified that error appears in the above-identified patent and that said Letters Patent are hereby corrected as shown below:

Col. 2, Line 33, change "3" to -- 2 --.

Col. 2, Line 38, change "6" to -- 5 --.

Signed and Sealed this

*Eleventh* Day of *December 1979*

[SEAL]

*Attest:*

SIDNEY A. DIAMOND

*Attesting Officer*

*Commissioner of Patents and Trademarks*